US005622346A

United States Patent [19]

Story, Jr.

[11] Patent Number: 5,622,346

[45] Date of Patent: Apr. 22, 1997

[54] COLLAPSIBLE CONTAINER HOLDER

[76] Inventor: David J. Story, Jr., 5027 Heritage Valley Dr., Douglasville, Ga. 30135

[21] Appl. No.: 297,137

[22] Filed: Aug. 29, 1994

[51] Int. Cl.[6] ..... A47F 5/00

[52] U.S. Cl. ..... 248/311.2; 248/205.2; D3/229

[58] Field of Search ..... 248/311.2, 205.2, 248/205.3, 205.4, 221.1, 316.8; D3/215, 229, 305

[56] References Cited

U.S. PATENT DOCUMENTS

| | | | |
|---|---|---|---|
| D. 272,774 | 2/1984 | Weissenburger | D3/229 |
| D. 281,830 | 12/1985 | Hengesbach | D3/229 |
| D. 353,045 | 12/1994 | Chandler | D3/229 |
| 4,759,963 | 7/1988 | Uso, Jr. et al. | 248/205.2 |
| 4,951,910 | 8/1990 | March | 248/205.2 |
| 5,104,076 | 4/1992 | Goodall, Jr. | 248/205.2 |
| 5,147,079 | 9/1992 | Heather | D3/229 |
| 5,407,110 | 4/1995 | Marsh, Jr. | D3/229 |

*Primary Examiner*—Alvin C. Chin-Shue
*Assistant Examiner*—Sarah L. Purol
*Attorney, Agent, or Firm*—Hinkle & Associates, P.C.

[57] ABSTRACT

A collapsible container holder that can be used to hold a variety of containers, and can be used during physical activities such as walking, jogging or hiking. The container holder includes a vertical member which is folded along its width to form two legs of a J-shape and has a plurality of loops along the length of the vertical member which are positioned so as to align one loop to another with one loop positioned on the main leg and the other loop positioned on the reentrant leg of the J-shaped vertical member; a plurality of horizontal members which are inserted into the loops in the vertical member with the ends of the horizontal members juxtaposed by adjustable hook and loop fastening means to form a round shaped pouch for holding the container; and a separate loop at the top of the vertical member to allow for external support.

20 Claims, 3 Drawing Sheets

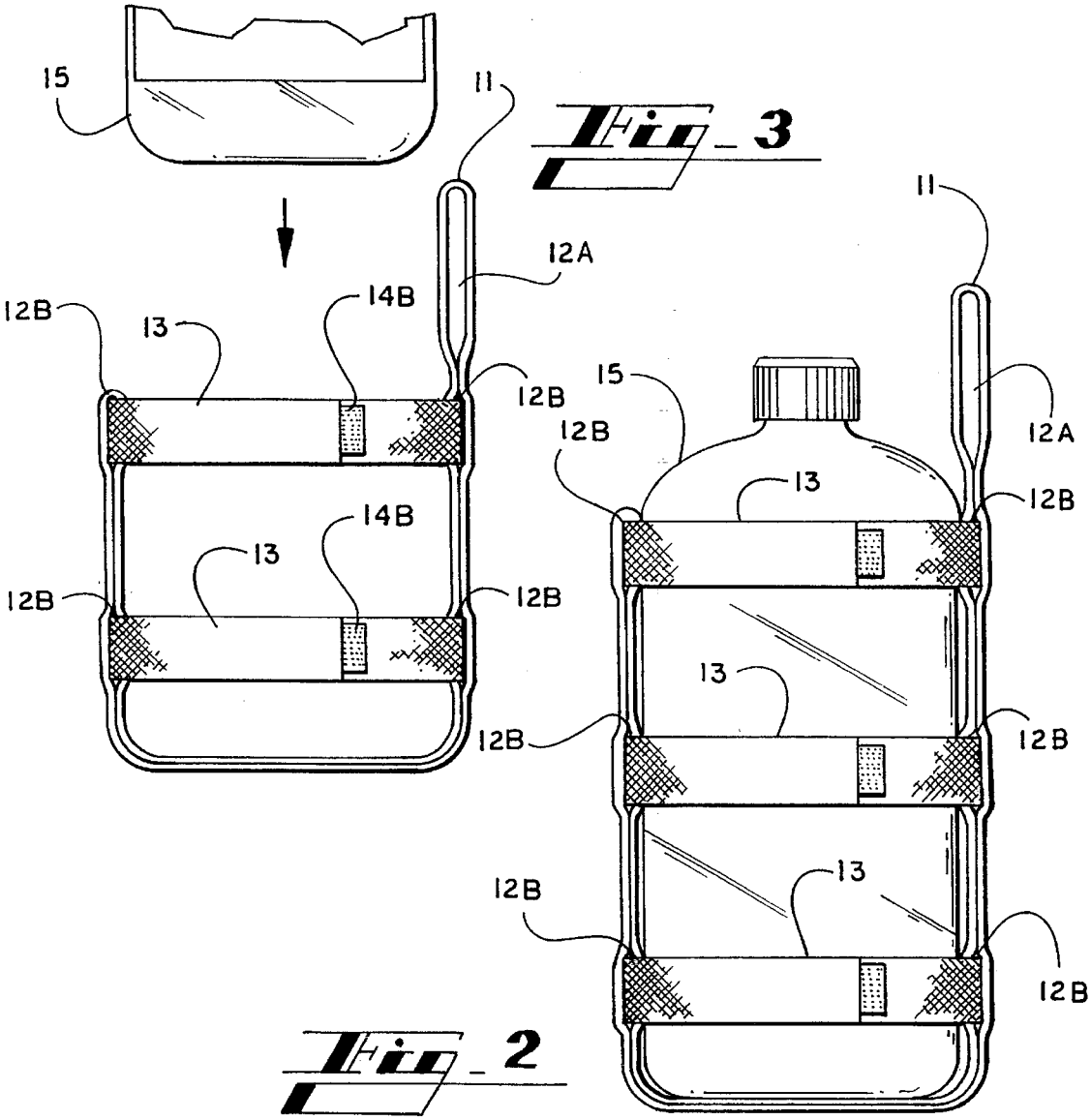
Fig. 3
Fig. 2
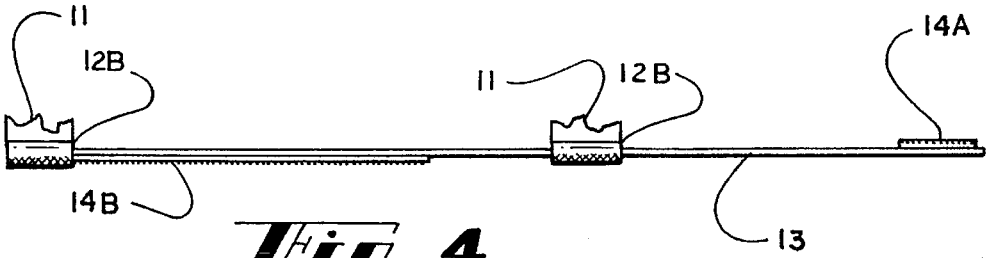
Fig. 4

COLLAPSIBLE CONTAINER HOLDER

BACKGROUND OF THE INVENTION

I. Field of the Invention

The present invention relates generally to the field of container holders, and more particularly to container holders that are collapsible and suitable for multiple uses.

II. Description of the Prior Art

It is well known in the prior art to support a container with some type of a pouch-shaped holder. However, none of the prior art container holders provide the combination of ease of use, ease of construction, collapsibility, and adjustability which is represented by the present invention.

SUMMARY OF THE INVENTION

The present invention is a container holder that is used to hold a variety of sizes of beverage containers; is durable and light weight for use during physical activities such its jogging, walking, or hiking; and is collapsible for easy storage and transport. The container holder comprises a vertical member of a flexible strap type material which is folded along its width to form a J-shape with a proximal end and a distal end, and at least one horizontal member made of the same material attached to both legs of the J-shaped vertical member at substantially a right angle and forming a round opening to accept beverage containers. The horizontal member or members have means for adjusting the circumference of the opening in order to accept containers of varying dimensions. The container holder has a loop at the top of the proximal end of the vertical member in order to allow for support from an ordinary belt. This loop can be adjustable in order to allow for other mounting arrangements.

Other objects, advantages and capabilities of the invention will become apparent from the following description taken in conjunction with the accompanying drawings showing preferred embodiments of the invention.

BRIEF DESCRIPTION OF THE DRAWINGS

FIG. 2 is a side elevation view of the container holder in use;

FIG. 3 is a side elevation view of an alternative embodiment of the container holder, with two horizontal members, ready to accept a container;

FIG. 4 is a broken away top view of a horizontal member showing the points of intersection with the vertical member and the positioning of the hook and loop fastening surfaces in order to allow for adjustment of the horizontal members for accepting containers of varying dimensions.

DESCRIPTION OF THE PREFERRED EMBODIMENTS

Figure 1:
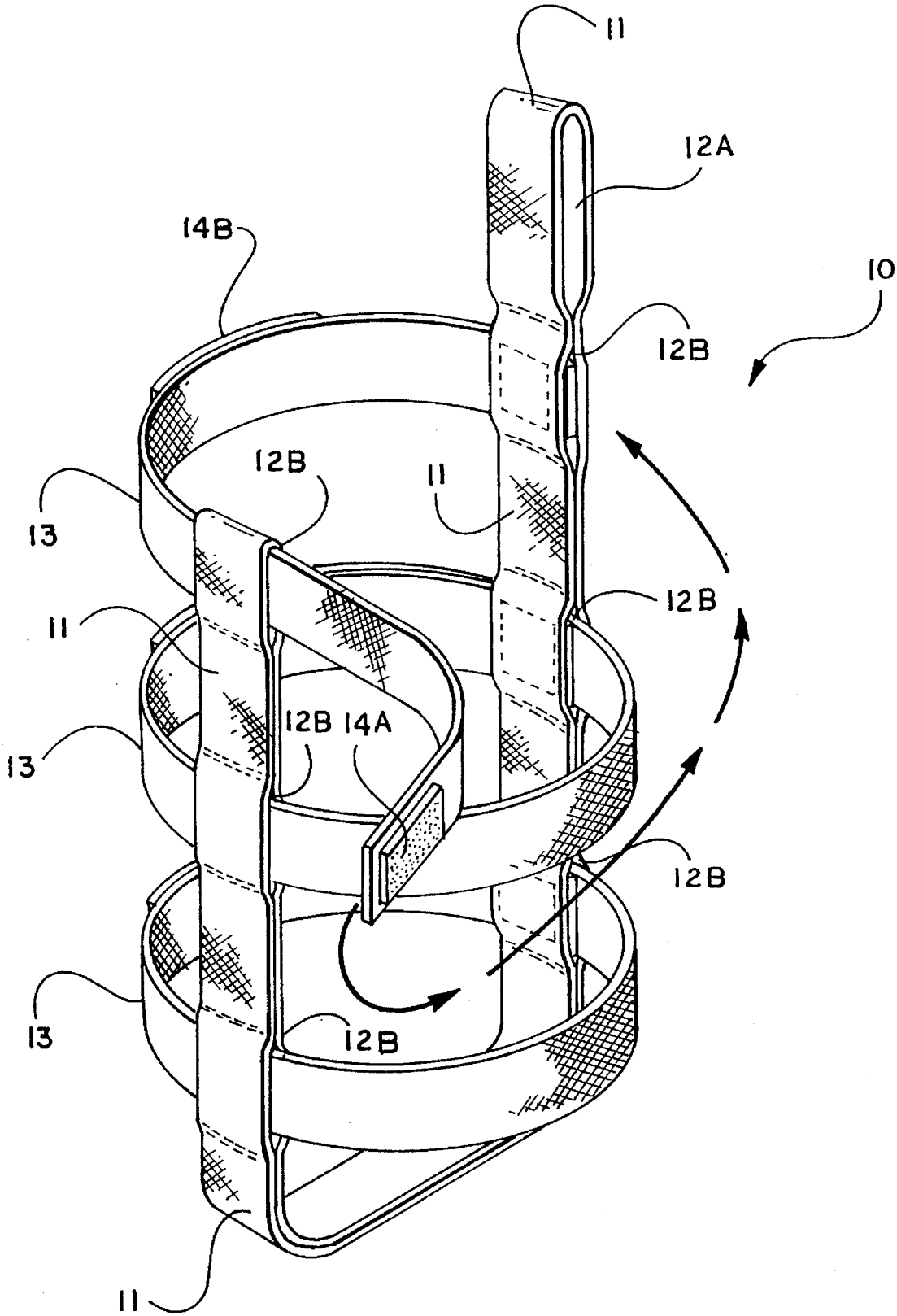
FIG. 1 is a perspective view of the container holder of the present invention shown with one horizontal member unhooked.

Referring to the drawings wherein like reference numerals designate corresponding parts throughout the several figures, FIG. 1 illustrates in a perspective view the collapsible container holder 10 of the present invention. Container holder 10 includes a vertical member 11 which is preferably constructed of woven, nylon strapping approximately one inch wide. The vertical member 11 is formed by taking a single ply piece of the strapping and attaching one end to the other to form a two ply member. The point where the ends meet is attached to the other ply near the middle of the member so that both ends of the member are made up of folded strapping. Throughout the body of the member the two plies are tacked together face to face in positions along the length of the member in order to form loops 12*a* and 12*b* where the two plies are unattached. The vertical member 11 has a proximal end and a distal end. The proximal end hits the auxiliary loop 12*a* which provides a point for attaching external support. This auxiliary loop 12*a* can be made adjustable by means of a hook and loop fastening system. The container holder 10 can be supported externally in a variety of ways, and typically from either the waist or the shoulder of the user. The vertical member 11 is formed into a J-shape with a reentrant leg at the distill end and a main leg at the proximal end. The two legs of the vertical member 11 are formed by folding the vertical member 11 along its width in at least one place along the length of the vertical member 11. The reentrant leg at the distal end holds the horizontal members in two places at the same height on the main and reentrant legs of the vertical member 11.

The primary loops 12*b*, which result from the two layers of the vertical member 11 being unattached in certain sections along the length of the vertical member 11, support the horizontal members 13 on the two legs of the J-shaped vertical member 11. The primary loops are positioned so as to align vertically one loop to another with one loop positioned on the main leg and the other loop positioned on the reentrant leg of the J-shaped vertical member 11. In this manner the horizontal members 13, when fed through the loops 12*b*, are positioned at substantially a right angle to the vertical member 11.

The horizontal members 13 are preferably made of a single ply of woven, nylon strapping about one inch wide with a hook fastening surface 14*a* on one side of a distal end and a loop fastening surface 14*b* on the opposite side of a proximal end. The horizontal members 13 provide support for the vertical member 11 and grip the container to hold it in place. In the open position as illustrated by the top horizontal member 13 in FIG. 1, the horizontal members 13 are positioned on the container holder 10 such that the proximal end of the horizontal member 13 is fastened to the loop 12*b* in the vertical member 11 and the distal end is loose and equipped with the hook fastening surface 14*a* on the inside. In order to place the horizontal members 13 in the closed position, the distal end of the horizontal member 13, which has the hook fastening surface 14*a*, is fed through the loops 12*b* as shown by the arrows in FIG. 1 and attached along the loop fastening surface 14*b*. In this manner, the circumference of the circle formed by the horizontal member 13 in the closed position can be adjusted. Upon placing the top horizontal member 13 in the closed position, the container holder 10 has a top round opening formed which receives the container 15 (shown in FIGS. 2 and 3). When all of the horizontal members 13 are in the closed position, the horizontal members support the vertical member 11 and surround the container 15.

In an alternative embodiment, the vertical member can be single ply with the horizontal members permanently attached to the two legs of the vertical member by means of a bar tack. In this embodiment, the loop 12*a* is formed by extending the vertical member at the proximal end and folding the extension to form a loop. The extension would have a proximal and a distal end with the distal end being attached to the back of the vertical member to form the loop.

Figure 5:
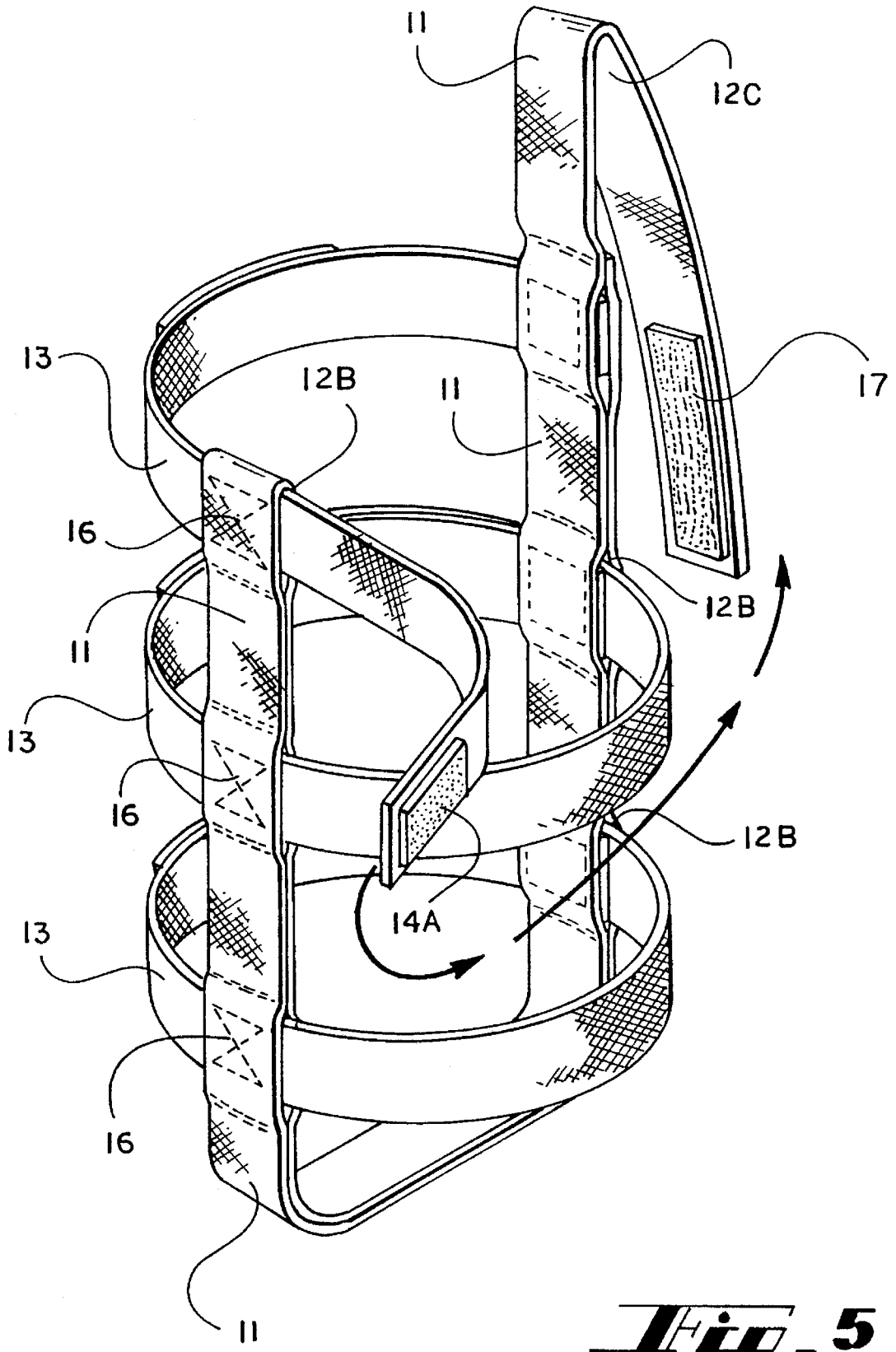
FIG. 5 is a perspective view of an alternative embodiment of the invention.

This loop can be made adjustable by means of a hook and loop fastening system. Also, in another alternative embodiment shown in FIG. 5, the loops 12*b* on the distal end of the vertical member could be replaced with a permanent attachment such as a bar tack 16. The other loops 12*b* on the proximal end would remain on the container holder in this embodiment in order to allow for the adjustability of the horizontal members. As in FIG. 5, the proximal end of the vertical member has an auxiliary loop 12*c* which can be made adjustable by means of a hook and loop fastening system. In this configuration loop 12*c* is shown with the hook portion 17 attached thereto for connection with the loop portion (not shown) attached to the rearmost portion of the main leg of the vertical member.

Reference is now made to FIG. 2 which illustrates in a side elevation view the container holder 10 holding a container 15 which has been placed into the holder through the top receiving opening. The horizontal members 13 are positioned snugly over the container 15 by means of the fastening surfaces 14*a* and 14*b* on each horizontal member 13.

FIG. 3 illustrates in a side elevation view the placement of the container 15 into the collapsible container holder 10 wherein the holder is a shortened version having two horizontal members 13, as opposed to a larger number of the horizontal members as depicted in FIGS. 1 and 2. It should be noted that the number of horizontal members may vary depending on the use to which the holder is put.

FIG. 4 illustrates, in a broken away top view, the fastening surfaces 14*a* and 14*b* at the distal and proximal ends of the horizontal member 13 which allow for the adjustment of the container holder 10 in order to accept a variety of containers with different dimensions.

Various modifications may be made of the invention without departing from the scope thereof and it is desired, therefore, that only such limitations shall be placed thereon as are imposed by the prior art and which are set forth in the appended claims.

What is claimed is:

1. A collapsible container holder, comprising a first flexible elongated member having a proximal end and a distal end whereby the first elongated member is abuttingly disposed about the container, the first elongated member having a first aperture adjacently spaced from the proximal end, the first elongated member having a second aperture oppositely spaced from the first aperture and adjacently spaced from the distal end, a second flexible elongated member having a first end adjacently spaced from the first aperture, the first end connectively disposed to the first elongated member, the second elongated member having a second end oppositely spaced from the first end, the second elongated member being spaced from the first elongated at substantially a right angle to the first member, the second elongated member traversing the second aperture whereby the second elongated member being abuttingly disposed about the container, the second elongated member traverses the first aperture, the second end of the second member being juxtaposed with and selectively spaced from the first end of the member and detachably secured thereto, and attachment means adjacently spaced from and connectively secured to the proximal end, for coupling the first member with an external support.

2. A collapsible container holder as claimed in claim 1, wherein the said attachment means comprises an extension from the proximal end of the first elongated member, the extension being folded to define a loop.

3. A collapsible container holder as claimed in claim 2, wherein the first elongated member comprises a front and a back side, the extension having a distal end attached to the back side of the first elongated member to define the loop.

4. A collapsible container holder as claimed in claim 3, wherein the distal end of the extension is removably attached to the back side of the first elongated member.

5. A collapsible container holder as claimed in claim 4, wherein the extension is removably attached by means of a hook and loop fastening system.

6. A collapsible container holder as claimed in claim 1, further comprising the first elongated member having at least two ply of flexible material, the plies being attached in staggered positions along the length of the first elongated member in order to form primary loops wherein at least one primary loop is formed at the proximal end of the first elongated member and at least one primary loop is formed at the end of the first elongated member.

7. A collapsible container holder as claimed in claim 6, further comprising the second elongated member being threaded through the primary loops in the proximal end and distal end of the first elongated member and having adjustable means for varying the circumference of the second elongated member when the proximal end and distal end of the second elongated member are placed in juxtaposition.

8. A collapsible container holder as claimed in claim 7, further comprising the second elongated member having a front side and a back side the adjustable means comprising the distal end of the second elongated member being removably attached to the back side of the proximal end of the second elongated member.

9. A collapsible container holder as claimed in claim 8, wherein the distal end of the second elongated member is removably attached by means of a hook and loop fastening system.

10. A collapsible container holder as claimed in claim 7, wherein the attachment means comprises an extension from the proximal end of the first elongated member, the extension being folded to form an auxiliary loop.

11. A collapsible container holder as claimed in claim 10, wherein the first elongated member comprises a front side and a back side, the extension having a distal end attached to the back side of the first elongated member to form the auxiliary loop.

12. A collapsible container holder as claimed in claim 11, wherein the distal end of the extension is removably attached to the back side of the first elongated member.

13. A collapsible container holder as claimed in claim 12, wherein the extension is removably attached by a hook and loop fastening system.

14. A collapsible container holder as claimed in claim 1 further comprising the first elongated member having at least two ply of flexible material, the plies being attached in staggered position along the length of the first elongated member order to form primary loops wherein at least one loop is formed on the first elongated member, the second elongated member being fixedly attached to the first elongated member and threaded through the primary loop in the first elongated member and having adjustable means for varying the circumference of the first elongated member when the proximal end and distal end of the second elongated member are placed in juxtaposition.

15. A collapsible container holder as claimed in claim 14, further comprising the second elongated member having a front side and a back side, the adjustable means comprise the distal end of the second elongated member being removably attached to the back side of the proximal end of the second elongated member.

16. A collapsible container holder as claimed in claim 15, wherein the distal end of the second elongated member is removably attached by means of a hook and loop fastening system.

17. A collapsible container holder as claimed in claim 14, wherein the attachment means comprise an extension from the proximal end of the first elongated member, the extension being folded to form an auxiliary loop.

18. A collapsible container holder as claimed in claim 17, wherein the first elongated member comprises a front side and a back side, the extension having a distal end attached to the back side of the first elongated member to form an auxiliary loop.

19. A collapsible container holder as claimed in claim 18, wherein the distal end of the extension is removably attracted to the back side of the first elongated member.

20. A collapsible container holder, comprising a first flexible elongated member having a proximal end and a distal end whereby the first elongated member is abuttingly disposed about the container, the first elongated member having a first aperture adjacently spaced from the proximal end, the first elongated member having a second aperture oppositely spaced from the first aperture and adjacently spaced from the distal end, a second flexible elongated member having a first end adjacently spaced from the first aperture, the first end connectively disposed to the first elongated member, the second elongated member having a second end oppositely spaced from the first end, the second elongated member being angularly spaced from the first elongated member and traversing the second aperture whereby the second member is abuttingly disposed about the container, and the second elongated member traverses the first aperture, the second end of the second member being juxtaposed with and selectively spaced from the first end of the second member, and detachably secured thereto.

* * * * *